United States Patent [19]

Banar et al.

[11] Patent Number: 4,745,277

[45] Date of Patent: May 17, 1988

[54] ROTARY TURRET AND REUSABLE SPECIMEN HOLDER FOR MASS SPECTROMETER

[75] Inventors: Joseph C. Banar, Los Alamos; Richard E. Perrin, Jemez Springs; Raymond A. Ostrenga, Los Alamos, all of N. Mex.

[73] Assignee: The United States of America as represented by the United States Department of Energy, Washington, D.C.

[21] Appl. No.: 915,840

[22] Filed: Oct. 6, 1986

[51] Int. Cl.[4] ..... H01J 49/04

[52] U.S. Cl. ..... 250/288; 250/281

[58] Field of Search ..... 250/288, 281

[56] References Cited

U.S. PATENT DOCUMENTS 2,756,341 7/1956 White ..... 250/288

4,156,814 5/1979 Hunt et al. ..... 250/288

*Primary Examiner*—Carolyn E. Fields

*Assistant Examiner*—Jack I. Berman

*Attorney, Agent, or Firm*—Milton D. Wyrick; Ray G. Wilson; Judson R. Hightower

[57] ABSTRACT

A sample holder for use in a mass spectrometer is provided for heating a sample to discharge ions through an electrostatic field which focuses and accelerates the ions for analysis. Individual specimen holders form a plurality of filaments for heating the sample materials for ion emission. Mounting devices hold the plurality of filaments at regular spaced apart angles in a closed configuration adjacent the electrostatic field elements. A substantially solid ceramic turret is provided with a plurality of electrical contacts which engage the individual holder means for energizing the filaments and forming a corresponding plurality of radially facing, axially extending first conductive surfaces. A substantially solid stationary turret bearing member is mounted about the rotating turret with a plurality of radially biased second electrical conductive surfaces, mounted to electrically contact facing ones of the plurality of radially facing first conductive surfaces. The assembly provides a large thermal mass for thermal stability and large electrical contact areas for repeatable, stable power input for heating the sample materials. An improved sample holder is also provided having a ceramic body portion for removably engaging conductive wires. The conductive wires are compatible with a selected filament element and the sample material to be analyzed.

14 Claims, 5 Drawing Sheets

ROTARY TURRET AND REUSABLE SPECIMEN HOLDER FOR MASS SPECTROMETER

This invention is the result of a contract with the Department of Energy (Contract No. W-7405-ENG-36).

BACKGROUND OF THE INVENTION

This invention generally relates to mass spectrometers and, more particularly, to filament holder assemblies for use in mass spectrometers.

Mass spectrometers are used in the qualitative analysis of various materials. Typically, a sample to be analyzed is formed on a filament of a high work function material such as platinum (Pt) or rhenium (Re) and the filament is heated for ion emission from the sample material. The emitted ions are then focused in an electrostatic lens assembly and accelerated into an electromagnetic field for ion separation and collection. It will be appreciated that ion emission, acceleration. and separation occur in a vacuum. It will also be appreciated that the emission of ions from impurity elements which are not part of the sample can greatly alter the results.

In conventional mass spectrometers, specimens are formed by attaching a filament across pins which are electrically connectable for heating the filament and which are insulatingly attached within the mass spectrometer. Specimen assemblies are inserted within the mass spectrometer one at a time to undergo a period of specimen preparation by preheating the specimen on the filament to get rid of impurities and to off-gas the specimen before analysis. The actual specimen analysis time may be quite short, but substantial time is required to first establish a vacuum and then to properly preheat the specimen filament before the analysis step.

In one attempt to provide an apparatus for measuring a number of samples in sequence, a rotatable filament holder is produced by Varian MAT as MAT 261, an automatic thermal ionization isotope mass spectrometer. The rotating turret provides electrical contacts using wiper-type contacts against wire leads. This arrangement does not provide reliable and consistent contact resistance, and heating current variations arise with resulting variations in the ion beam and concomitant measurement inaccuracies. Further, the Varian device is assembled from numerous pieces fabricated from sheet stock. A low thermal mass is obtained which allows undesirable thermal transients to occur. Further, a large surface area is produced which requires substantial time to precondition in a vacuum to prevent sample contamination from surface impurities and absorbed gases.

The present invention provides for multiple sequential sample analysis in a rotating turret having a high degree of reproducible conditions and thermal stability for sample analysis and further provides reusable filament holders to improve operator convenience and to reduce costs.

Accordingly, one objective of the present invention is to provide an apparatus for sequential analysis of multiple filamentary samples which are loaded in a common vaccuum system.

Another objective of the present invention is to provide an apparatus which enables a sample to be pretreated for analysis in parallel with a sample analysis, but without contaminating the analysis results.

One other objective of the present invention is to provide stable, rotatable electrical contacts for consistent, reproducible current delivery for filament heating.

A further objective of the present invention is to provide a sequential analysis system having few parts yet with a large heat capacity for thermal stability.

Still another objective of the present invention is to provide improved cleanability and decontamination for rotating components, particularly insulative parts.

Yet another objective of the present invention is to provide a reusable filament pin holder.

One more objective of the present invention is to provide component material having surface characteristics and a minimum surface area effective for reduced surface contamination.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of present invention, as embodied and broadly described herein, the apparatus of this invention may comprise a turret assembly defining an axis of rotation and rotatably supplying a plurality of material samples for mass spectrographic analysis. A filament holder is provided for rotatably mounting a plurality of filaments for heating material samples with each of the filaments exposable for spectrographic analysis. Rotatable electrical elements define radial contact areas parallel with said axis of rotation for supplying current for heating a first of the filaments for sample analysis and heating a second of the filaments for pretreatment. The second filament is angularly separated from the first filament for effective contamination control. A housing is provided about the rotatable filament holder and the rotatable electrical contact elements for establishing and maintaining a vacuum.

In another characterization of the present invention, a mass spectrometer for material analysis is provided with a sample holder for heating a sample to discharge ions, electrostatic field generating means for focusing and accelerating the ions, and means for separating the ions as a function of ion mass. The sample holder is provided with individual holder means for forming a first plurality of filaments for heating sample materials. Mounting devices hold the first plurality of filaments at regular spaced apart angles in a closed configuration. A substantially solid ceramic turret is then provided with a central borehole defining an axis and a second plurality of peripheral axial first boreholes therethrough parallel with said axis and at an angular spacing functionally related to the regular spaced apart angles for the filaments. A plurality of electrical contacts engages the individual holder means effective for energizing selected ones of the sample materials and extending through the peripheral first boreholes, and forming a corresponding plurality of radially facing, axially extending first conductive surfaces. A substantially solid stationary turret bearing member is mounted about the ceramic turret with a plurality of second axial boreholes angularly spaced in correspondence with the selected ones of the sample materials. A plurality of radially biased second electrical conductive surfaces are mounted in the plurality of second boreholes effective to electrically contact facing ones of the plurality of radially facing first conductive surfaces for energizing the selected ones of the plurality of sample materials. A rotating mechanism engages the ceramic turret for rotating the ceramic turret, the plurality of first conductive surfaces, and the plurality of samples to a position for heating one sample while simultaneously energizing at least a second sample for pretreatment prior to analysis.

In a subassembly of the present invention, a sample holder is provided for use in a mass spectrometer. A ceramic body portion removably and insulatively engages the mass spectrometer. A filament element is provided for heating sample material placed on the filament. Two conductive wires which are weldable to the filament element provide for energizing the filament and removably engage the ceramic body portion for filament replacement.

BRIEF DESCRIPTION OF THE DRAWINGS

The accompanying drawings, which are incorporated in and form a part of the specification, illustrate the embodiment of the present invention and, together with the description, serve to explain the principles of the invention. In the drawings.

DETAILED DESCRIPTION OF A PREFERRED EMBODIMENT

Figure 1:
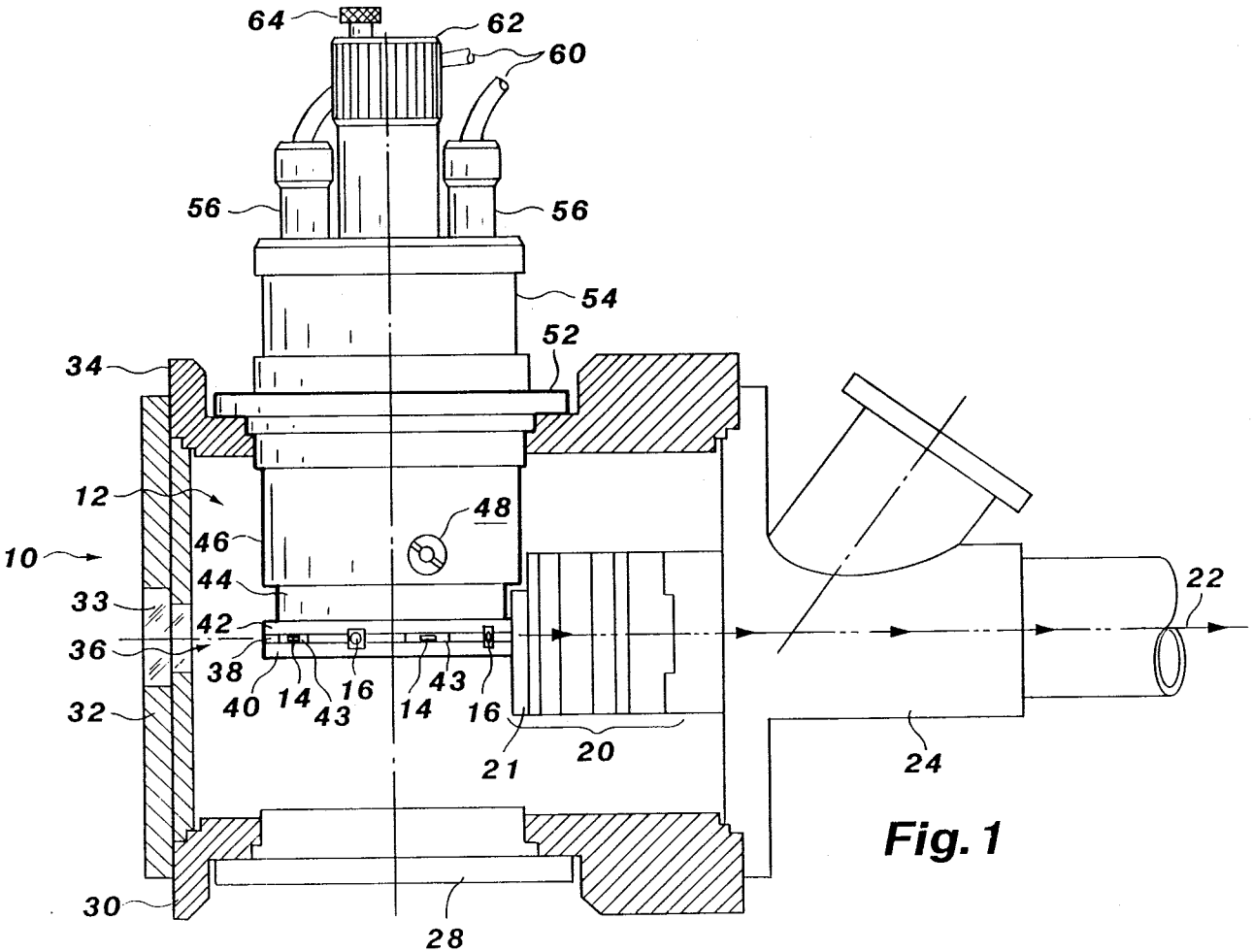
FIG. 1 is an overall assembly drawing of one embodiment of a mass spectrometer having a multiple filament analysis turret according to the present invention.

Referring first to FIG. 1, there is shown an assembly drawing in partial cutaway of a mass spectrometer with turret assembly 12 mounted in source housing 10. Sample materials 14 are mounted on filaments within slits 43 for heating and ion evaporation and acceleration within a generally conventional ion lens assembly 20. End cap 21 is part of lens assembly 20 and is adapted to provide a voltage adjacent slits 43 for shaping the electromagnetic field adjacent samples 14 and affecting the emitted ions. Lens assembly 20 then focuses the emitted ions through outlet assembly 24 to form ion beam 22 for separation by the mass spectrometer.

Source housing 10 provides bottom housing cover 28 mounted on housing bottom flange 30 for interior access. Side cover 32 is provided opposite ion beam outlet 24 and includes viewing window 33 for optical access to a heated filamentary sample 14 for temperature measurement, as hereinafter discussed. Housing top flange 34 accommodates turret assembly 12 for mounting.

Turret assembly 12 further includes filament mounting assembly 36 having filament holder ring 38 held between outside cover 40 and inside cover 42. As hereinafter explained, mounting assembly 36 may be disassembled for replacing filament samples 14. Filament holder ring 38 defines slits 43 which form the ionization chamber when the filament 14 is heated for analysis. The temperature of a filament 14 being heated in a slit 43 may be optically monitored through filament viewing path 16 provided in mounting assembly 36.

Turret drive 44 is rotatably mounted within turret bearing 46 for sequentially analyzing the samples. Index detent 48 provides positive rotational positioning for turret drive 44. Turret mounting flange 52 sealingly engages housing top flange 34 to enable a vacuum to be established within source housing 10. A protective cover 54 which provides electrical feedthroughs for insulating caps 56 is mounted above turret flange 52. Rotation of turret drive 44 and filaments 14 is provided through indexing knob 62, which may be locked at a selected position with locking knob 64.

It will be appreciated from FIG. 1 that filament mounting assembly 36 rotatably engages lens assembly 20 for positioning filament 14 within end cap 21. Filament 14 is then substantially shielded by shield plate 58 from cross-contamination while being heated for ion evaporation and analysis. Lens assembly 20 is provided with a high voltage from an external voltage supply (not shown). End cap 21 is provided with electrical contact 60 for establishing filament mounting assembly 36 at a voltage effective to accelerate ions emitted from a sample on filaments 14.

Figure 2A:
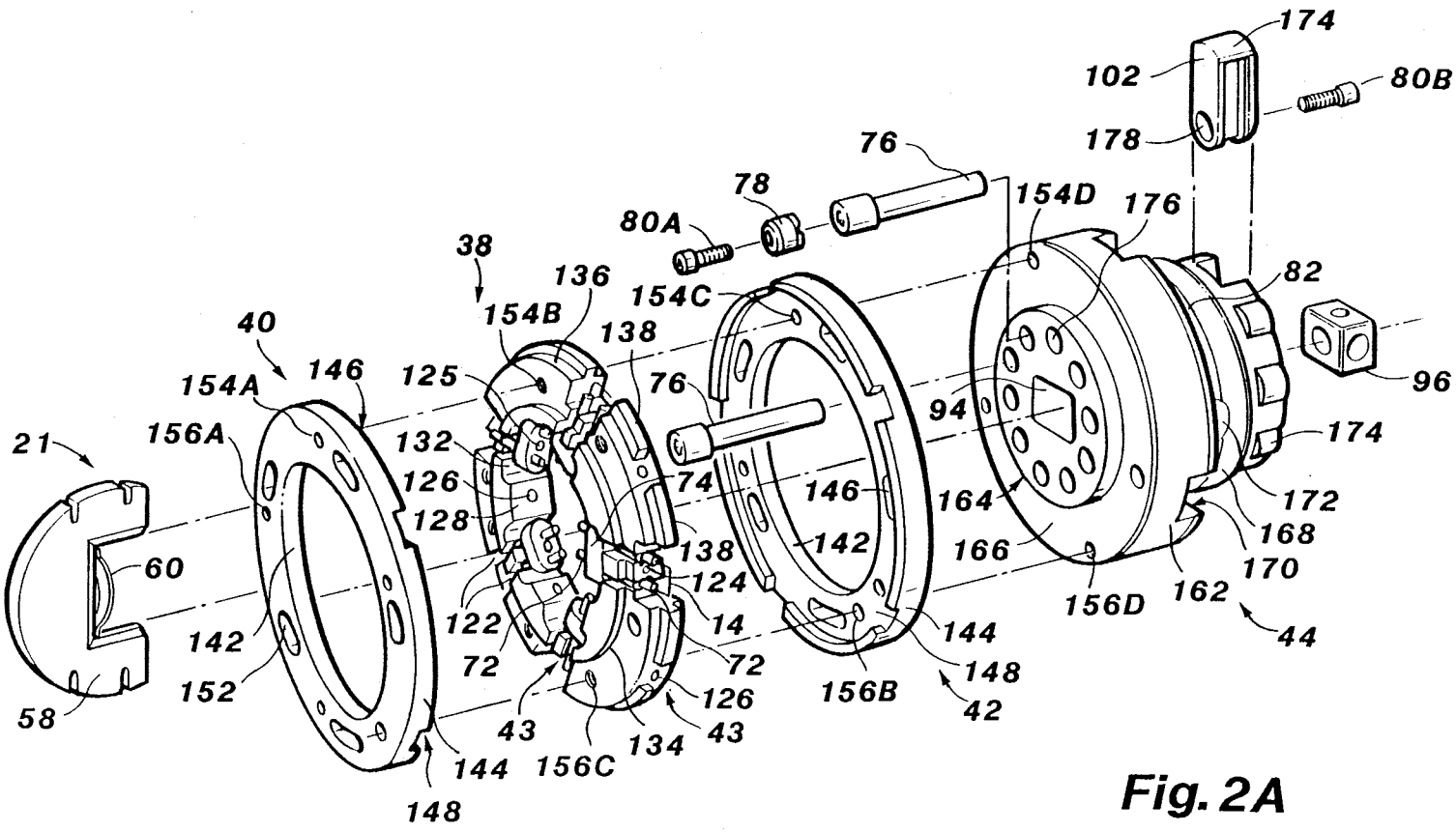
FIGS. 2A and 2B are exploded views in pictorial isometric of the analysis turret shown in FIG. 1.
Figure 2B:
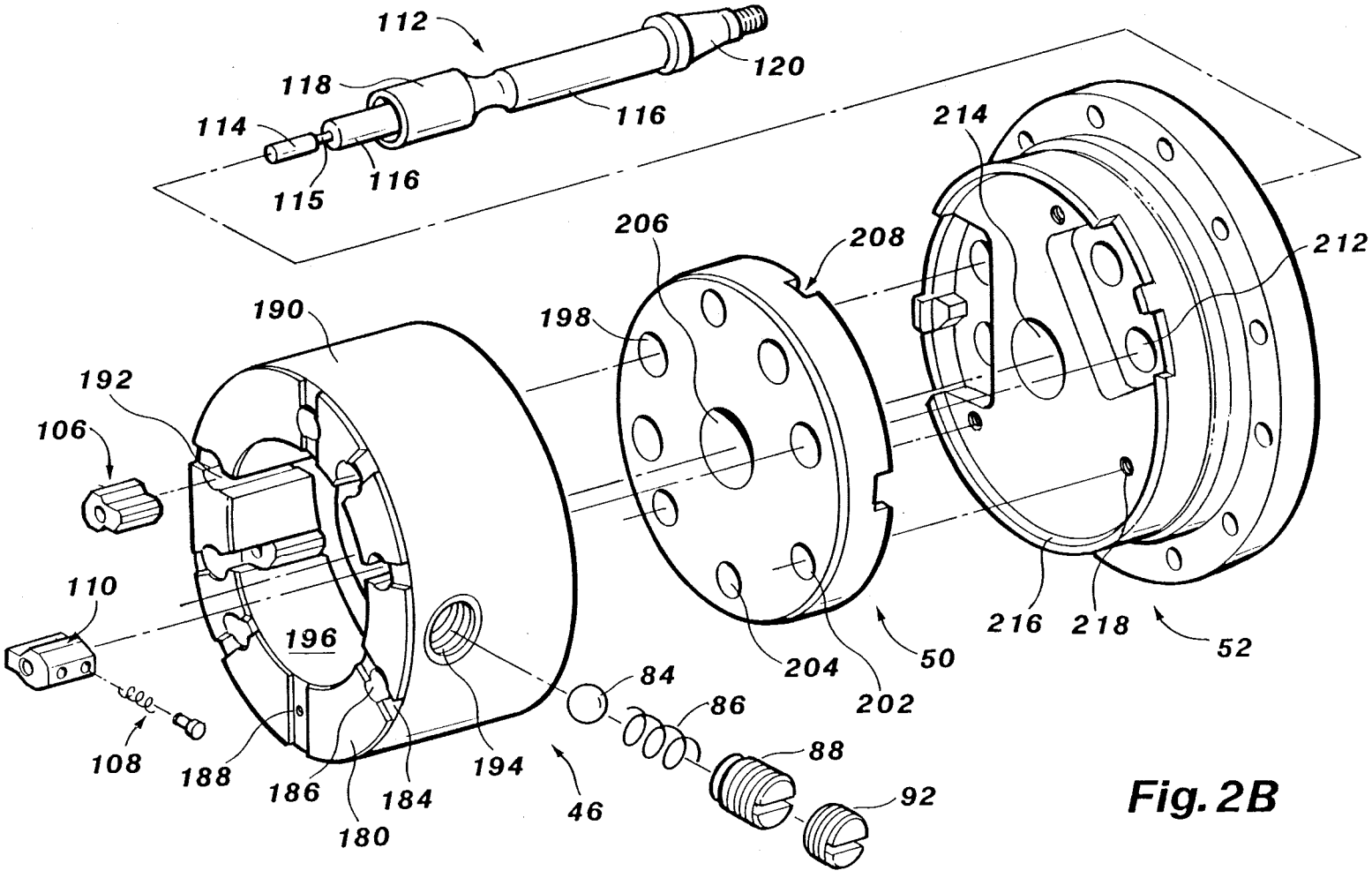

Referring now to FIGS. 2A and 2B, there is shown in exploding view component parts forming turret assembly 12 in FIG. 1. FIG. 2A more particularly depicts the rotating elements of turret assembly 12. FIG. 2B more particularly depicts the stationary components of turret assembly 12 which provide various bearing surfaces and for electrical feedthrough.

Referring now to FIG. 2A, mounting assembly 36 (FIG. 1) is formed from filament holder ring 38, outside cover 40, and inside cover 42. Filament holder ring 38 mounts a filament sample 14 (five places) within a slit 43 (five places). Filament sample 14 is mounted to conductive filament holder pins 72, generally by welding. Pins 72 are mounted within ceramic filament pin insulating support 74 (more particularly described in FIG. 4). Insulating support 74 engages mounting slots (five pairs) 122 for alignment within ring 38. Filament holder ring 38 also provides optical access to filament 14. Thus, a set of filament view holes 124, filament holder view ports 125, and outside view ports 126 are diametrically aligned for visual access to filamentary sample 14. It will be noted that the preferred embodiment described herein provides five sample positions wherein five view ports 124 and 126 are provided and each ceramic support 74 includes a view port 125.

Filament holder ring 38 further defines inner diameter 128 for radial positioning about mounting and locating shoulder 164 of turret drive 44. Mounting flats 132 (five) are provided about inner diameter 128 for mounting filament holder 74. Seating ledges 134 on the top and bottom surfaces of filament holder ring 38 mate with the inner seating diameters 142 of outside cover 40 and inside cover 42. Holder ring 38 further defines diameter 136 which, in turn, defines ionization chamber slots 43. Spacing flanges 138 (five places) are formed at a diameter substantially the same as outer and inner covers 40, 42. Assembly holes 156C are provided for use in fastening together mounting assembly 36 with assembly screw holes 156A and 156B in outside and inside covers 40, 42, respectively.

Outside cover 40 and inside cover 42 are substantially identical in mirror image, except where outside cover 40 includes openings 152 (five) for venting from within mounting assembly 36 when a vacuum is being established. Thus, inner seating diameters 142 mate with shoulders 134 of filament holder ring 38. Outer diameters 144 further define notches 148 (five per ring) for optical access. Alignment pin holes 154A, B, C are provided in filament holder ring 38 and outside and inside covers 40, 42 to insure that mounting assembly 36 is precisely aligned.

It will be appreciated that the components of mounting assembly 36 (FIG. 1), i.e., filament holder ring 38, outside cover 40, and inside cover 42, are fabricated from stainless steel materials which cooperate with lens assembly 20 in forming and shaping the electrostatic field which initially focuses and accelerates the evaporated ions. As hereinbelow described, the ceramic material forming significant components of turret assembly 12 has a small coefficient of thermal expansion and enables small tolerances and close alignment to be maintained. Thus, a f preferred width of about 0.120 inches can be provided for slits 43 to control the shape of the initial electrostatic field which accelerates ions emitted from filaments 14.

End cap 21 surrounds mounting assembly 36 with shield plate 58 within lens assembly 20 to minimize cross-contamination. End cap 21 is further provided with contact spring 60 to engage mounting assembly 36 at a voltage potential effective to accelerate the emitted ions.

Mounting assembly 36 is secured to turret drive 44 through assembly screw hole 156D (three places) for rotation therewith. Turret drive 44 includes ceramic body section 162 and electrical components, i.e. contact pin holder 76 and electrical contact 102, along with assorted connecting devices, to form the rotating bearing surfaces and radial electrical connections.

Polygonal borehole 94 engages a rotating mechanism, including drive member 96, to provide the required drive connection. Body portion 162 defines alignment surface 164, axial thrust bearing surface 170, radial alignment and bearing surface 168, and axial boreholes (ten) 176. Radial bearing surface 168 further defines detent groove 82 with defined detent position 172 (five) for accurately rotationally positioning turret drive 44.

Contact pin holder 76 is insertable within an axial borehole 176 for providing electrical feedthrough. Pin clamping cap 78 engages a corresponding filament holder pin 72 and secures to contact pin holder 76 by a locking bolt 80A to establish an electrical contact with a filament 14. Contact pin holder 76 extends through body portion 162 to engage electrical contact 102 through stepped bore 178. Electrical contact 102 is radially oriented providing radial electrical contact face 174. Contact pin holder 76 is secured within stepped bore 178 by a locking bolt 80B.

Referring now to FIG. 2B, the stationary components of turret assembly 12 (FIG. 1) are shown in an exploded isometric view. Thrust bearing assembly 46 includes a ceramic body portion 190 which defines axial bearing surface 180 and radial bearing surface 196 for alignment and bearing contact with surfaces 168 and 170, respectively, of turret drive 44 (FIG. 2A). Ceramic body portion 190 further defines threaded assembly 194, vacuum evacuation slots 184, mounting holes 186, dowel locating hole 188, and axial electrical contact slots 192. Detent components, detent ball 84, loading spring 86, detent plug 88, and locking cap 92, are secured within threaded hole 194. Floating electrical polygonal contacts 106 include polygonal body portion 110 for floating engagement within electrical contact slots 192.

Two pairs of electrical contact slots 192 are provided and spaced apart at an angle for electrically energizing two filaments at a time. In a preferred embodiment, the energized filaments are nonadjacent filaments to reduce contamination and are spaced apart 144° where five filaments are provided. Electrical contacts 106 are urged in a radial direction by spring loading plunger assemblies 108 to provide radial electrical contact along axially directed, radially facing surface 174 of electrical contact 102 in turret drive 44 (FIG. 2A). Electrical contact is made over a large axial surface area to provide a stable contact for reproducible filament currents. By way of example, a surface area of about 0.25 $in^2$ has been provided along each radial contact, axial surface to handle a current of 5 amps.

Insulator plate 50 is provided above turret bearing 46. Insulator plate 50 defines electrical assembly feedthrough openings 198 (four), mounting bolt holes 202 (three), alignment dowel hole 204, center hole 206 for the rotating mechanism, and evacuation slots 208 for use in evacuating the assembly.

Turret mounting flange 52 is secured to the stationary turret components (see FIG. 1) through mounting holes 218 (three) which align above mounting holes 202 in insulator plate 50 and mounting holes 186 in ceramic body portion 190. Mounting flange 52 further defines counter-bore 216 for accepting and aligning ceramic body portion 190 and insulator plate 50 with electrical contact feedthrough holes 212.

Electrical power is supplied to floating electrical contacts 106 through insulating and sealing caps 56 (FIG. 1) and through electrical feedthrough assembly 112. Electrical feedthrough assembly 112 includes top connector 120 for connecting with external power supply wires 60 (FIG. 1). Conductive wire 115 extends within assembly 112 through porcelain insulators 116 to wire adapter plug 114. Wire adapter plug 114 may conveniently be silver to assure a uniform electrical contact within floating electrical contact 106 in a friction-type fit. Electrical assembly 112 further includes a weldable skirt 118 for attaching within mounting flange 52 with a vacuum-tight seal.

Figure 3:
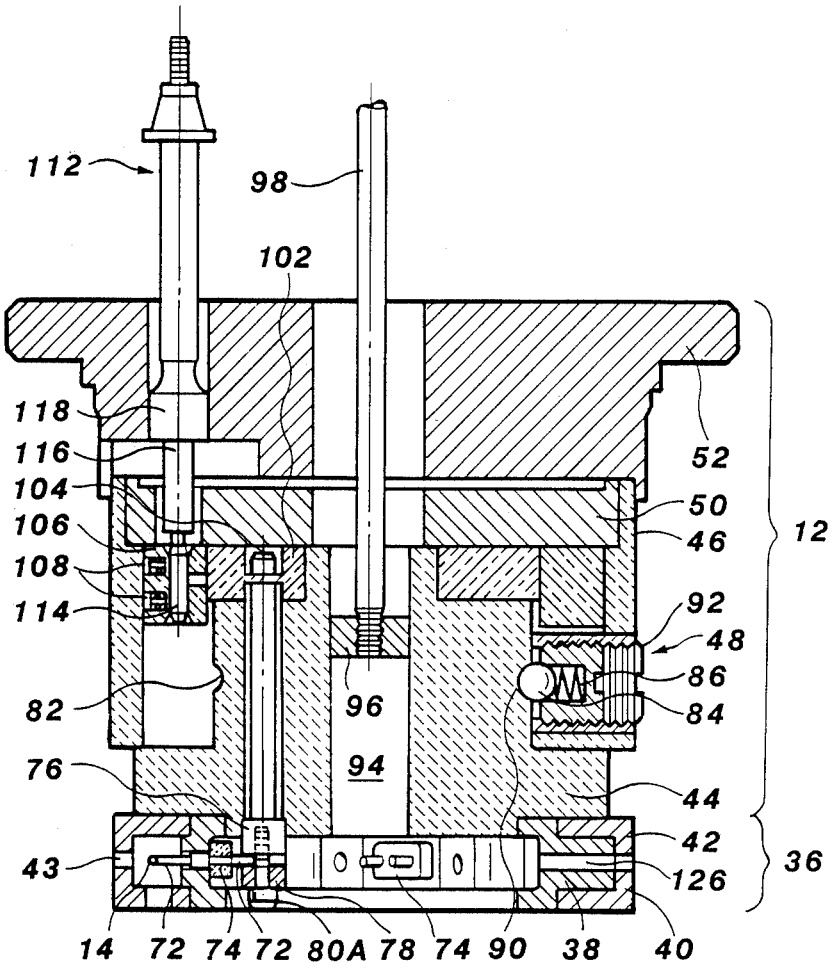
FIG. 3 is a cross-sectional assembly view of the components shown in FIGS. 2A and 2B.

Referring now to FIG. 3, there is shown a cross-sectional view of the assembled components depicted in FIGS. 2A and 2B. Turret assembly 12 is mounted for rotating filament mounting assembly 36 with sample filaments 14. Filaments 14 are conventionally welded to filament holder pin 72 which is insulatively supported by ceramic insulating support body 74. Filament holder pin 72 is clamped electrically to contact pin holder 76 by pin clamping cap 78 and bolt 80A.

Ceramic filament insulating support body 74 is disposed within filament holder ring 38 to support sample filaments 14 between outside cover 40 and inside cover 42 and adjacent ionization chamber slit 43. In the course of a spectrographic analysis, an optical path is established through holes 126, 125, and 124 (FIG. 2A) to enable the temperature of the filament to be determined.

Ceramic turret drive 44 is mounted within ceramic turret bearing 46 to provide axial and radial alignment and bearing surfaces, described above. Turret drive 44 is rotated by turning polygonal turret drive 96 through drive shaft 98, which engages a commercial rotary feedthrough assembly (not shown).

Contact pin holder 76 extends through turret drive 44 to electrically engage contact 102. Bolt 80B secures pin holder 76 to contact 102. Electrical contact 102 provides radial electrical contact with floating electrical contact 106 along axial surfaces of contacts 102 and 106. Floating contact 106 is radially urged against rotating contact 102 by spring loaded plunger assemblies 108.

Turret drive 44 is provided with a plurality of positioning detents 90 to accurately locate the samples into position for analysis. Detent ball 84 is urged radially against detent groove 82 formed in turret drive 44 and provides a positive indication when a detent position 90 is engaged. Ball 84 and spring 86 are held in a compressed position by detent plug 88 and locking cap 92.

Turret bearing 46 does not rotate and is capped by insulator plate 50. Insulator plate 50 provides for electrically placing wire adapter plug 114 within floating contact 106.

Turret assembly 12 is capped with flange 52 which provides for sealing the specimen assembly within a vacuum housing. Electrical feedthrough assembly 112 further includes weldable skirt 118 for sealingly securing electrical feedthrough assembly 112 within flange 52.

In a preferred embodiment, turret drive 44, turret bearing 46, and insulator plate 50 are fabricated from ceramic materials, preferably a ceramic marketed as Coor's AD 94. The preferred material does not contribute undesirable impurities to the spectrographic analysis. The ceramic material also exhibits relatively high dimensional stability over the normal temperature range (up to about 400° C.) and enables a precise alignment to be maintained. Further, the material can be subjected to severe cleaning conditions, such as high temperature heating and acid cleaning, to remove any residual and accumulated contaminates which could affect the spectrographic analysis results.

It is a particular feature of the rotary turret apparatus hereinabove described to provide a substantially solid assembly for relative thermal stability. By substantially solid it is meant that only such material volume is removed as needed for component placement and feedthroughs, assembly and alignment of components, and vacuum access. Ceramic rotating body section 162 (FIG. 2A) and stationary body portion 190 (FIG. 2B) provide void space only as necessary for electrical connections, component assembly, and vacuum bleeding. The substantially solid ceramic body portions 162 and 190 thus enable two significant operating advantages:

1. The surface areas are greatly reduced over prior rotating filament holders and the resulting reduction in surface adsorption from the choice of ceramic and the substantially solid design available with ceramic enable a vacuum to be established in only about an hour.

2. A large thermal mass is obtained and only small, slow temperature fluctuations arise during power input variations rather than rapid, large transients where area sheet metal components are provided.

Yet another operating advantage is obtained from the relatively large area radial electrical contact axial surfaces between rotating contacts 102 and floating contacts 106. The resulting contact resistance is relatively low and is not subject to any large variations from only small changes in the quality of the contact surfaces. Thus, a highly repeatable input current is available to obtain the filament excitation with resultant sample heating to form the ion beam current.

Figure 4:
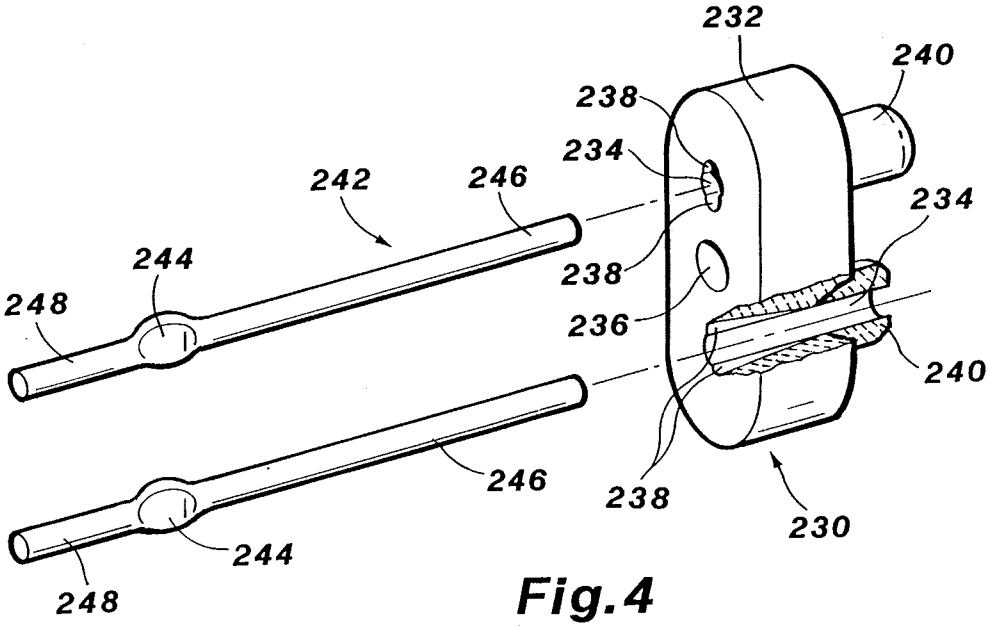
FIG. 4 is an illustration of a filament sample holder according to one embodiment of the present invention.

Referring now to FIG. 4, there is shown an important subassembly of the present invention, a reusable filament holder. As herein described, the ceramic pin holder is sized to replace conventional sample filament holders and to be reusable. Ceramic pin holder body 230 is provided, preferably of Coor's AD 995 ceramic. Contaminates from a previous sample can be removed from the ceramic by acid cleaning to eliminate carryover materials which would contaminate the results from a subsequent analysis. The preferred ceramic is made from aluminum oxide and is capable of withstanding high temperatures during thermal evaporation of ions from the sample without material degradation or loss of dimensional stability. Any aluminum oxide and aluminum ions which may evolve in the process are typically removed from the region of the spectra of interest. Conventional sample holders can provide isobaric interferences from the metal and glass material which are conventionally used and these emissions greatly increase analysis errors, particularly where isotope ratio measurements are made.

The ceramic body portion 232 enables a pin 242 material to be selected which does not produce interfering ions to further reduce the precision, accuracy, and range of measurements which can be obtained. Platinum support pins and rhenium filaments may be selected to eliminate the rare earth elements from the background spectra. Rhenium filaments and support pins eliminate Rt, Rh, Pd, and Ir from the background spectra. The use of Pt support pins and either Pt or Re filament materials significantly reduces the background spectra where specimens are from the transition elements. The background spectra of prior art specimen holders simply do not permit the relative contributions to the spectrum from the sample and the pin holders to be determined.

The use of tungsten support pins and tungsten filaments permits the use of temperatures in excess of 2200° C. without significant increases in the alkali metal backgrounds. The glass used as insulation in commercially available support pins degrades at these temperatures with large increases in the alkali element spectra, with increased arcing and eventual loss of dimensional stability for the support pins and filaments.

Ceramic pin holder body 232 includes stand-offs 240 for mating with alignment slots in filament holder ring 38 (see FIGS. 2A, 2B, and 3) and further defines optical viewing hole 236 for use in determining the actual filament temperature during the analysis. Insertion and locking holes 234, 238 are provided in body portion 232 for removably locking pins 242 in place. Pin hole 234 accepts filament end portion 246 which extends beyond stand-offs 240 for filament attachment. Pin locking slots 238 are provided at an angle (preferably 10°) to the axis of pin holes 234 to provide a tapered configuration for the locking slot within ceramic body 232. Pin 242 includes locking swage 244 which engages tapered locking slots 238 to removably wedge in position. End portion 248 remains extended beyond body 232 for electrically connecting with electrical feedthroughs provided in the turret assembly and described above.

It is apparent that the reusable ceramic filament pin holder, hereinabove described, provides a wide range of flexibility. The reusable body portions can be subjected to severe cleaning, e.g., boiled in aqua-regia acid, to eliminate contaminates from the ceramic. Further, the pin 242 material can be selected for minimum, if any, interference with the material being analyzed. A desired pin 242 material can be inserted and wedged in place and thereafter lightly tapped for removal from within body portion 232. Filaments may then be suitably secured to pins 242, such as by welding. Pins 242 can be frequently reused by removing residual filaments by mechanical severing or by acid cleaning.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A turret assembly for rotatably supplying a plurality of material samples for mass spectrographic analysis comprising:

holder means for mounting said plurality of material samples with each of said material samples exposable for said spectrographic analysis;

rotatable electrical radial contact means for heating a first of said samples for analysis and heating a second of said samples for pretreatment where said second sample is angularly separated from said first sample for effective contamination control;

substantially solid body means for supporting and relatively rotating said electrical radial contact means and said holder means while aligning said holder means for said spectrographic analysis; and housing means about said holder means and said rotatable electrical contact means for establishing and maintaining a vacuum.

2. A turret according to claim 1, wherein:

an odd number of said material samples are provided having substantially uniform angular spacing about said holder means; and said holder means includes viewing access means diametrically opposite each of said material samples for optical viewing.

3. A turret according to claim 1, wherein said holder means further includes a replaceable carrier for each said material sample having two conductive wires, a filament weldable to said conductive wires for heating said sample and a ceramic stand-off for removably receiving said conductive wires and insulatively holding said conductive wires for electrical contact with said rotatable electrical contact means.

4. A turret according to claim 3, wherein said ceramic stand-off is formed from a ceramic material which does not interfere with the mass spectrographic analysis and defining a pair of holes therethrough for accepting said conductive wires and a third hole effective for optically viewing said filament.

5. A turret according to claim 1, wherein said rotatable electrical contact means includes:

first radial electrical contacts mounted for rotation with said holder means and electrically connected for heating with each of said material samples.

second radial electrical contacts in stationary arrangement radially about said first electrical contacts for simultaneously heating two of said material samples.

6. A turret according to claim 1, wherein said holder means further includes:

a mounting assembly for said plurality of material samples defining a sample enclosure having five sides around each of said samples and outwardly facing openings for ion discharge when each of said samples is heated, said mounting assembly being configured to further define an electrostatic field boundary condition for accelerating said ions from said samples.

7. A mass spectrometer for material analysis having a sample holder for heating a sample to discharge ions, electromagnetic field generating means for focusing and accelerating said ions, and means for separating said ions as a function of mass. said sample holder comprising:

individual holder means for forming a plurality of sample materials;

mounting means for holding said plurality of sample materials at regular spaced apart angles in a closed configuration;

a substantially solid ceramic turret having a central axial bore hole and a plurality of peripheral axial first boreholes therethrough at an angular spacing functionally related to said regular spaced apart angles for said sample materials;

a plurality of electrical contacts engaging said individual holder means effective for energizing selected ones of said sample materials extending through said peripheral first boreholes, and forming a corresponding plurality of radially facing first conductive surfaces;

a substantially solid stationary turret bearing member mounted around said ceramic turret having a plurality of second boreholes angularly spaced in correspondence with said selected ones of said sample materials;

a plurality of radially biased second electrical conductive surfaces in said plurality of second boreholes effective to electrically contact facing ones of said plurality of radially facing first conductive surfaces for energizing said selected ones of said plurality of sample materials; and rotating means engaging said ceramic turret for rotating said ceramic turret, said plurality of first conductive surfaces, and said plurality of samples to a position for heating one sample while simultaneously energizing at least a second sample for pretreatment prior to analysis.

8. A mass spectrometer according to claim 7, wherein:

said mounting means comprises an odd number of said material samples at said regular spaced apart angles; and said individual holder means include viewing access means diametrically opposite each of said material samples for optical viewing.

9. A mass spectrometer according to claim 7, wherein said individual holder means further includes a replaceable carrier for each said material sample including two conductive wires, a filament weldable to said conductive wires for heating said sample and a ceramic stand-off for insulatively holding said conductive wires for electrical contact with said rotatable electrical contact means.

10. A mass spectrometer according to claim 9, wherein said ceramic stand-off is formed by a ceramic material which does not interfere with the mass spectrographic analysis and defining a pair of holes therethrough for accepting said conductive wires and a third hole effective for optically viewing said filamentary material samples.

11. A mass spectrometer according to claim 7, wherein said mounting means further includes:

an enclosure having five sides around each of said samples and outwardly facing openings for ion discharge when each of said samples is heated; and said enclosure being configured to further define an electrostatic field boundary condition for accelerating said ions from said samples.

12. A sample filament element holder for use in a mass spectrometer comprising:

a ceramic body portion for removably and insulatively engaging said mass spectrometers.

filament means for heating material samples to be analyzed;

two conductive wires weldable to said filament for energizing said filament and effective to removably engage said ceramic body portion for replacing said filament and said conductive wires within said ceramic body portion; each said conductive wire is swaged at a predetermined location.

13. A sample holder according to claim 12, wherein said ceramic body portion is formed from a ceramic material which does not interfere with the mass spectrographic analysis and defining a pair of holes therethrough for accepting said conductive wires and a third hole effective for optically viewing said filament.

14. A sample holder according to claim 13 wherein:

each of said pair of holes through said ceramic body portion includes an inlet having a shape effective for receiving and removably holding said swaged portion of said conductive wire within said body portion.

* * * * *